US012018910B1

(12) United States Patent
Christensen

(10) Patent No.: US 12,018,910 B1
(45) Date of Patent: Jun. 25, 2024

(54) HOLSTER FACILITATING MASTER GRIP

(71) Applicant: Douglas J. Christensen, Medina, MN (US)

(72) Inventor: Douglas J. Christensen, Medina, MN (US)

( * ) Notice: Subject to any disclaimer, the term of this patent is extended or adjusted under 35 U.S.C. 154(b) by 0 days.

(21) Appl. No.: 17/369,860

(22) Filed: Jul. 7, 2021

Related U.S. Application Data

(63) Continuation-in-part of application No. 16/698,501, filed on Nov. 27, 2019, now abandoned.

(60) Provisional application No. 62/771,700, filed on Nov. 27, 2018.

(51) Int. Cl.
*F41C 33/02* (2006.01)

(52) U.S. Cl.
CPC ..... *F41C 33/0236* (2013.01)

(58) Field of Classification Search
CPC ..... F41C 33/0209; F41C 33/0263; F41C 33/0227; F41C 33/0272
USPC ..... 224/196, 198, 192, 193, 243
See application file for complete search history.

(56) References Cited

U.S. PATENT DOCUMENTS 1,230,043 A * 6/1917 Shelton ..... F41C 33/0218 224/911
3,630,420 A * 12/1971 Bianchi ..... F41C 33/0227 224/193
3,718,240 A 2/1973 Rose
3,910,469 A 10/1975 Baldocchi
4,256,245 A 3/1981 Serres
4,298,150 A * 11/1981 Seldeen ..... F41C 33/0281 224/912
4,387,523 A 6/1983 Gallagher
4,689,908 A 9/1987 McClellan
5,100,036 A 3/1992 Rogers et al.
5,167,355 A 12/1992 Hill
5,275,317 A 1/1994 Rogers et al.
5,284,281 A * 2/1994 Nichols ..... F41C 33/0263 224/244
5,372,288 A 12/1994 Rogers et al.
5,467,909 A 11/1995 Resca et al.
5,598,958 A * 2/1997 Ryan, III ..... F41C 33/0254 224/678
5,622,295 A 4/1997 Hellweg et al.
6,112,962 A 9/2000 Matthews
6,732,891 B2 * 5/2004 Locklear, III ..... F41C 33/0272 224/244
6,948,644 B1 9/2005 Beletsky
7,140,523 B2 11/2006 Lowe et al.
7,258,259 B1 8/2007 Owens
(Continued)

FOREIGN PATENT DOCUMENTS

DE 29602597 U 7/1996
DE 29602597 U1 * 7/1996 ..... F41C 33/0209
WO WO 2010/064268 A1 6/2010

OTHER PUBLICATIONS

Kind, Albrecht; Holster Support Flange Operate Weapon Insert Direction Right Angle, Jul. 4, 1996; DE 29602597 U1 (Year: 1996).*

*Primary Examiner* — Nathan J Newhouse
*Assistant Examiner* — Lester L Vanterpool

(57) ABSTRACT

A polymer holster has an index finger slot on a distal wall portion of the holster for allowing a user to grip a handgun therein with a master grip before withdrawing the handgun therefrom. A thumb actuated release may be positioned on a proximal wall portion of the holster.

8 Claims, 8 Drawing Sheets

(56) References Cited

U.S. PATENT DOCUMENTS

| | | | | |
|---|---|---|---|---|
| 7,584,875 | B2 | 9/2009 | Lowe et al. | |
| 7,694,860 | B2 | 4/2010 | Clifton, Jr. | |
| 8,177,108 | B1 | 5/2012 | Kincaid et al. | |
| 8,602,275 | B1 | 12/2013 | Kiger et al. | |
| 8,631,981 | B2 | 1/2014 | Zusman | |
| 8,684,242 | B2 * | 4/2014 | Pomeroy | F41C 33/0209 224/198 |
| 8,720,755 | B2 | 5/2014 | Gregory et al. | |
| 8,851,344 | B2 | 10/2014 | Baumann et al. | |
| 8,925,773 | B2 | 1/2015 | Clifton | |
| 9,057,580 | B2 * | 6/2015 | Rorick | F41C 33/0263 |
| 9,109,857 | B2 | 8/2015 | Kendrick | |
| 9,134,093 | B2 | 9/2015 | Yeates | |
| 9,393,165 | B2 | 7/2016 | Pettigrew et al. | |
| 9,759,515 | B2 | 9/2017 | Yeates | |
| 10,018,447 | B1 * | 7/2018 | Alford | F41C 33/0272 |
| 10,619,974 | B2 | 4/2020 | Smith et al. | |
| 2003/0042279 | A1 | 3/2003 | Locklear, III | |
| 2005/0279790 | A1 | 12/2005 | Lowe | |
| 2006/0011680 | A1 | 1/2006 | Cook et al. | |
| 2007/0170215 | A1 * | 7/2007 | Evans | F41C 33/0263 224/192 |
| 2008/0110947 | A1 | 5/2008 | Pikielny | |
| 2010/0276464 | A1 | 11/2010 | Hirt et al. | |
| 2017/0276453 | A1 * | 9/2017 | Lance | F41C 33/02 |
| 2019/0293386 | A1 * | 9/2019 | Smith | F41C 33/0236 |

* cited by examiner

HOLSTER FACILITATING MASTER GRIP

CROSS-REFERENCE TO RELATED APPLICATIONS

This application is a continuation-in-part of U.S. application Ser. No. 16/698,501, filed Nov. 27, 2019, which claims priority to U.S. Provisional Application 62/771,700 filed Nov. 27, 2018. Said applications are incorporated herein by reference in their entireties.

BACKGROUND OF THE INVENTION

Holsters, particularly when used for law enforcement and military situations needs to be highly secure when holstered and reliably, intuitively, and safely unholstered in stressful situations ready for firing. When unholstered, the handgun is ideally in the master grip with the forefinger positioned on the handgun body above the trigger region. As the handgun is withdrawn and if the forefinger is not properly placed, the forefinger can migrate to the trigger region upon unholstering potentially causing an unintended discharge of the handgun.

SUMMARY OF THE INVENTION

Early handgun holster designs comprised pocket halves hand stitched together to form the handgun receiving pocket and with an attached leather belt. Retention means comprised gravity and potentially friction from the engagement between the pistol and leather pocket. Flexible leather straps or leather strips that extend over the exposed part of the handgun could secure the handgun in the holster. The early holster designs were primarily for revolvers.

The majority of holsters now utilize rigid polymer holster bodies and are made for receiving semi-automatic handguns having upper slides. The sidewalls of bodies that extend around the mass produced holsters have dramatically improved retention capabilities with different levels of retention available depending upon the need. One intended goal of such retention features is to prevent others from easily unholstering the handgun when in a struggle with the person wearing the holster and handgun, such as a law enforcement person. Holster retention capabilities are often categorized in three levels: level I, level II and level III. Level I typically equates to a conforming friction engagement for passive retention. Level II has an active mechanism that needs manual release to withdraw the handgun. Level III has two mechanical retention means for securing the handgun in the holster.

The manual release of the retention means is almost always by the same hand that grips and withdraws the holster, such as by an index finger or thumb release. See, for example, all of which are incorporated by reference herein for all purposes.

Conventional modern holsters typically have polymer housings that encompass the top, both sides, and the bottom of the handgun forward of the hand grip. Three fingers of the user's hand encircle the handgrip and the forefinger, the trigger finger and thumb extending forwardly with one or both of the thumb and index finger being used to actuate the holster release mechanism. When the handgun is withdrawn, the forefinger, and usually the thumb need to transition from a holster engagement position before withdrawal to a handgun engagement as the handgun leaves the holster.

Although holsters may have surface structure on the holster to direct the users forefinger to the correct location, even with such structure, upon withdrawal of the handgun and the transition of the forefinger from engaging the holster to engaging the handgun, the forefinger needs to move inward to engage the handgun. The transition can be problematic, particularly in stressful situations, grasping of the hand on the handgun can cause the forefinger positioning to shift moving to the trigger region. Any improvements in holsters to facilitate reliable and intuitive unholstering and facilitating the master grip when unholstered would be welcomed by users and the industry.

Allowing the index finger to engage the side of the handgun before the handgun is withdrawn from the holster provides a secure and stable master grip immediately as the handgun is withdrawn with the index finger pointing forward and resting on the side of the handgun above the trigger and trigger guard region. A feature and advantage of the handgun is that there is no transition of the index finger from a holster engagement while the handgun is holstered to forefinger/handgun body engagement as the handgun is being withdrawn from the holster. A feature and advantage of embodiments is that when the handgun is gripped in the holster, it is gripped in the master grip and no transition of fingers is required as and after the handgun is unholstered.

A feature and advantage of embodiments is that the slot of the side of the holster provides positive tactile indication of where the index finger should be placed, the polymer housing defining the slot and the handgun frame within the slot, provides a locating feature that provides a high degree of certainty that the user will properly grip the handgun in the holster for a reliable and quick withdrawal.

A feature and advantage of embodiments is a textured, serrated, rough, beaded, bumped, or other non-smooth surface is provided at a lower margin of the forefinger slot to remind and cue the user to not lower the forefinger to the trigger area as the handgun is unholstered.

A feature and advantage of embodiments of the invention is a holster with a polymer injection molded body that that allows the user to engage the handgun when holstered with the user's index finger providing a stable, secure, and safe gripping of the handgun as it is withdrawn with no transition of the index finger from holster engagement to handgun engagement during the withdrawal process. In embodiments, a finger sized slot extends downward from an upper edge portion of the holster exposing the handgun at a portion of the handgun body intermediate between the slide and the trigger and trigger guard. In embodiments, the slot is defined by parallel or substantially parallel housing edge portions that extend downward toward the bottom of the holster and forwardly with respect to the handgun.

A feature and advantage of embodiments is a holster that provides near normal enclosure of the handgun by the holster while facilitating a secure withdrawal and master grip.

A holster with a slot for the index finger along the side of the weapon allowing handgun engagement along the holster body above the trigger guard when the handgun is still holstered facilitates the proper master grip when the holster is withdrawn.

A feature and advantage of embodiments is a holster body with a slot positioned at the index finger side of the holster body, the slot receiving inserts that can adjust the size of an elongate opening to the handgun body contained therein or close the slot.

A feature and advantage of embodiments is that the index finger is allowed to engage the body of the handgun before the complete withdrawal of the handgun from the holster, and wherein the distal wall portion precludes the index finger from reaching or engaging the trigger.

A feature and advantage of embodiments is that the holster allows complete extension of the index finger and contact with the handgun while the index finger is completely extended and before the handgun is withdrawn from the holster. A feature and advantage of embodiments is that the user may use one motion to reach downward to grasp the handgun allowing unholstering without altering the grasping of the handgun.

In embodiments of the invention, the slot for receiving the user's straightened index finger may have a cover or barrier thereover allowing insertion of the index finger below the cover or barrier.

A feature and advantage of embodiments of the invention, the distal phalanx and middle phalanx are in contact with the frame of the handgun prior to and as the handgun is being removed from the holster.

In embodiments, a holster in combination with a semiautomatic handgun having an upper slide, when the handgun is holstered, the holster has a slot extending from the rearward end of the holster forwardly and configured and sized for a user's forefinger and positioned to place the user's forefinger on the body of the handgun below the slide and above the trigger region. The slot extend at least the length of at least the distal phalange of the forefinger. The slot upper margin positioned at or below a juncture of the slide and the body of the handgun, the slot lower margin positioned above the trigger region on the body of the handgun. In embodiments, the handgun has a rib positioned above the trigger guard region, the rib exposed when the handgun is holstered such that the user's forefinger can engage the rib providing a reminder and cue to hold the forefinger in place on the body of the handgun as the handgun is unholstered.

DETAILED DESCRIPTION

Figure 1:
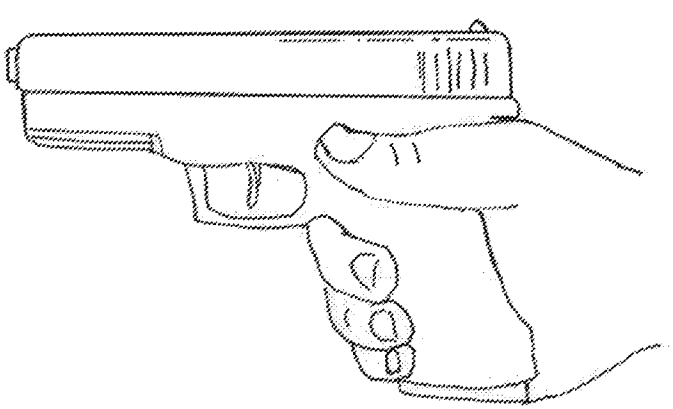
FIGS. 1 and 2 illustrate a master grip.
Figure 2:
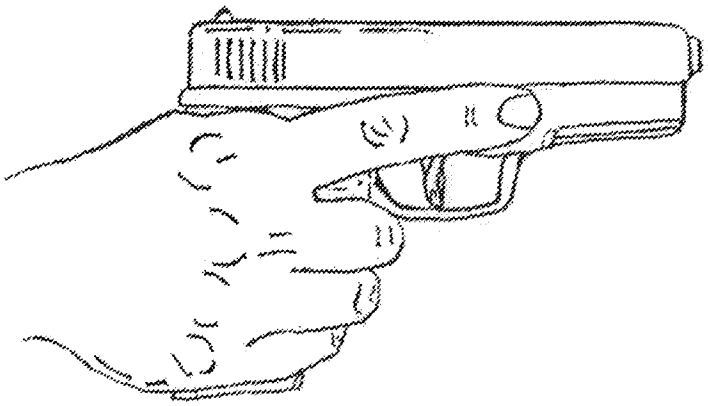
Figure 3:
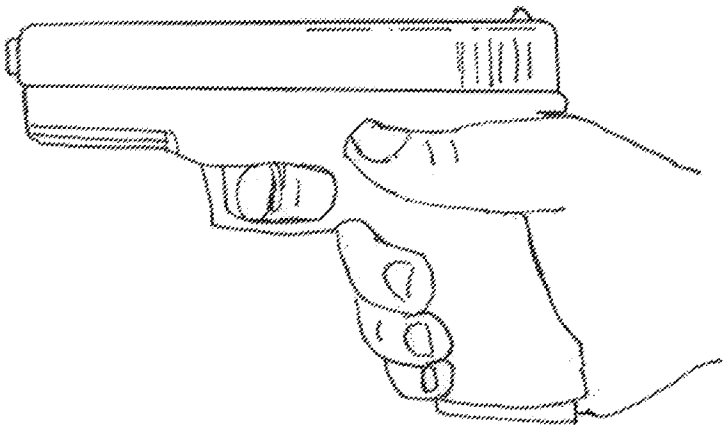
FIGS. 3 and 4 illustrate the master grip transitioned to a ready to fire position with the index finger on the trigger.
Figure 4:
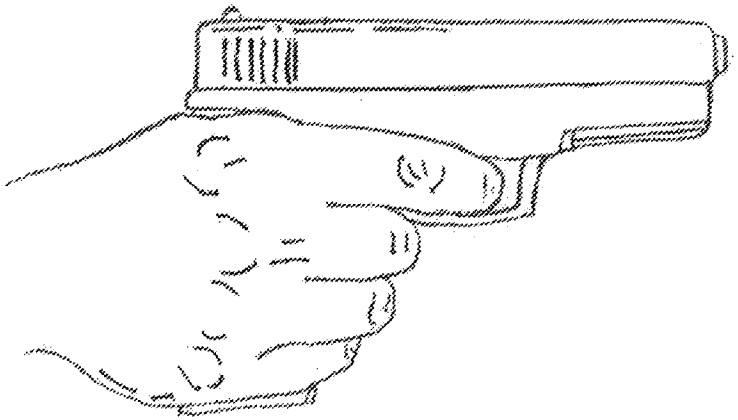

Referring to FIGS. 1-2 the well known "master grip" for gripping handguns is illustrated with the users forefinger on the body of the handgun above the trigger region. FIGS. 3-4 illustrate the ready-to-fire grip with the finger at the trigger.

Figure 5A:
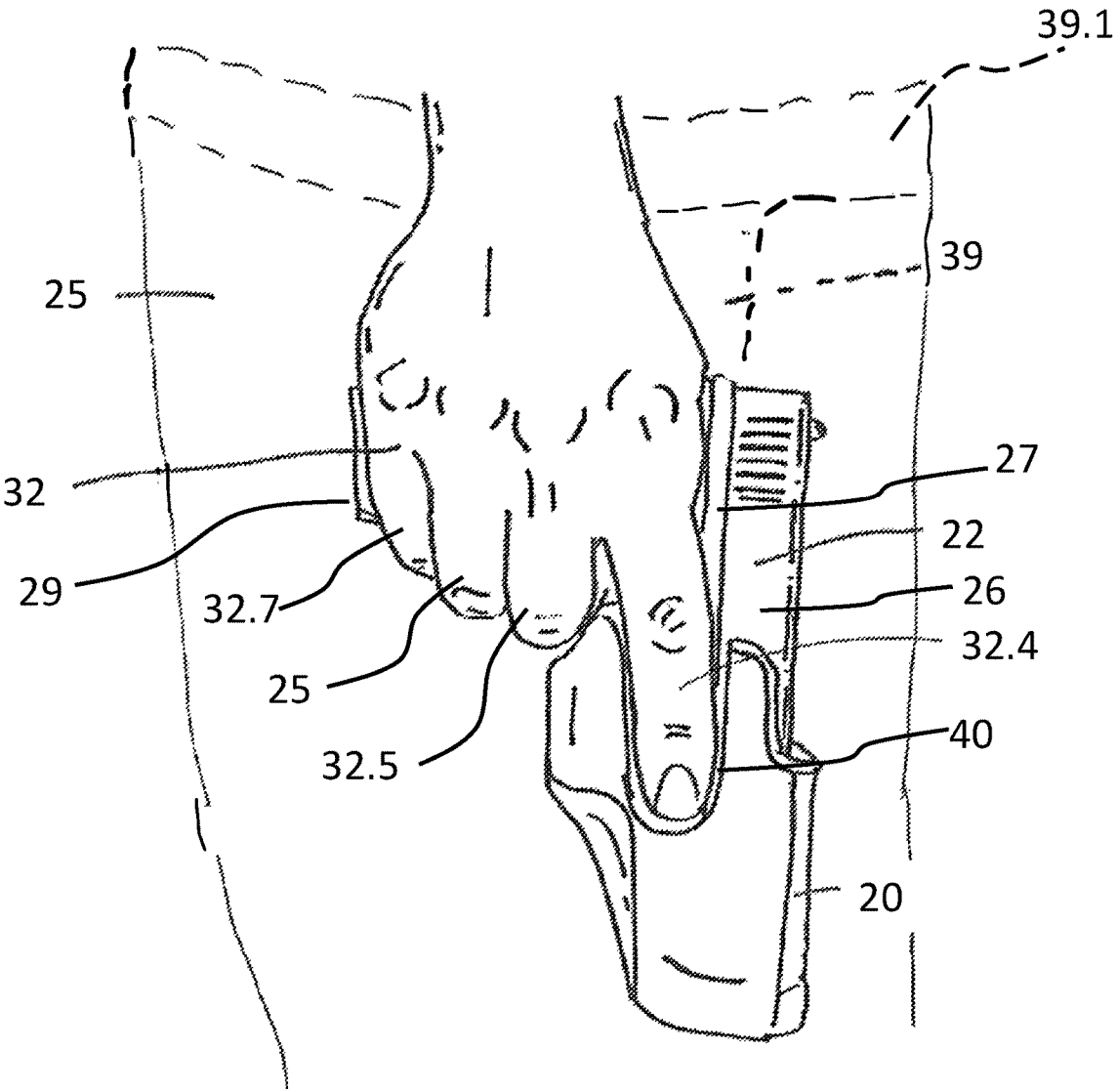
FIG. 5A illustrates a holster in accord with embodiments having a handgun therein gripped by a user, the user gripping the handgun with the master grip.
Figure 5B:
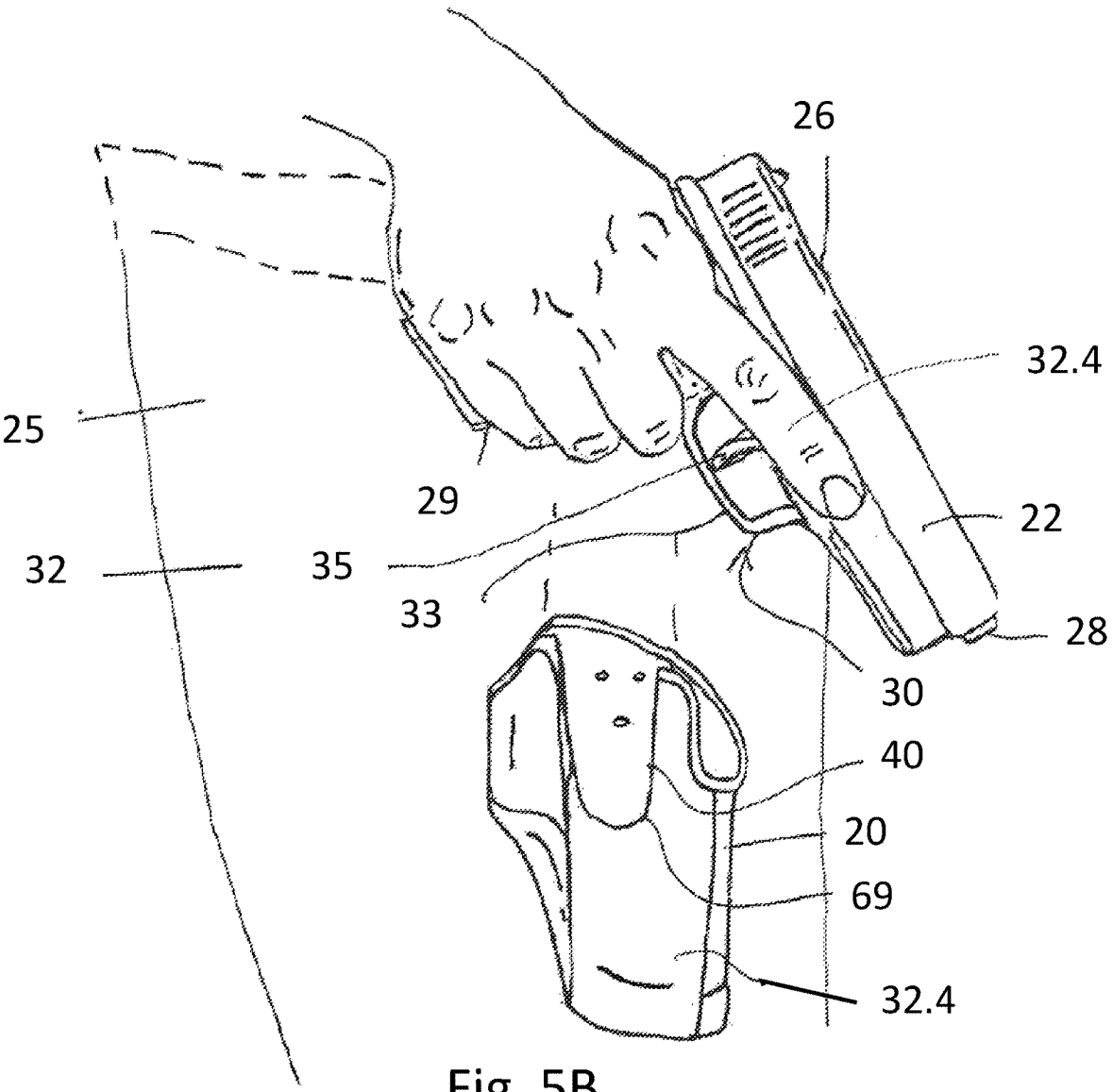
FIG. 5B illustrates the holster and handgun of FIG. 5A with the handgun withdrawn and with the handgun being grasped in the master grip.

Referring to FIGS. 5A and 5B, a holster 20 with a handgun 22 therein being worn by a user 25. The handgun being a semiautomatic handgun with an upper slide 26 on a body 27, a barrel 28, a grip 29, a trigger region 30, with a trigger guard 33 and a trigger 35. The holster secured to the user by conventional attachment means 39, such as a strap, for securing the holster to the user's belt 39.1 or elsewhere. The user gripping the handgun with his hand 32 with the master grip prior to withdrawal of the holster from the handgun. The user's forefinger 32.4 is positioned in a master grip forefinger slot 40 of the holster, the middle finger 32.5, the ring finger 32.6 and the little finger 32.7 are wrapped around and are gripping the grip 29. The user's forefinger 32.4 is pressed against the handgun body 27 between the upper slide 26 and the trigger region 30.

Figure 6:
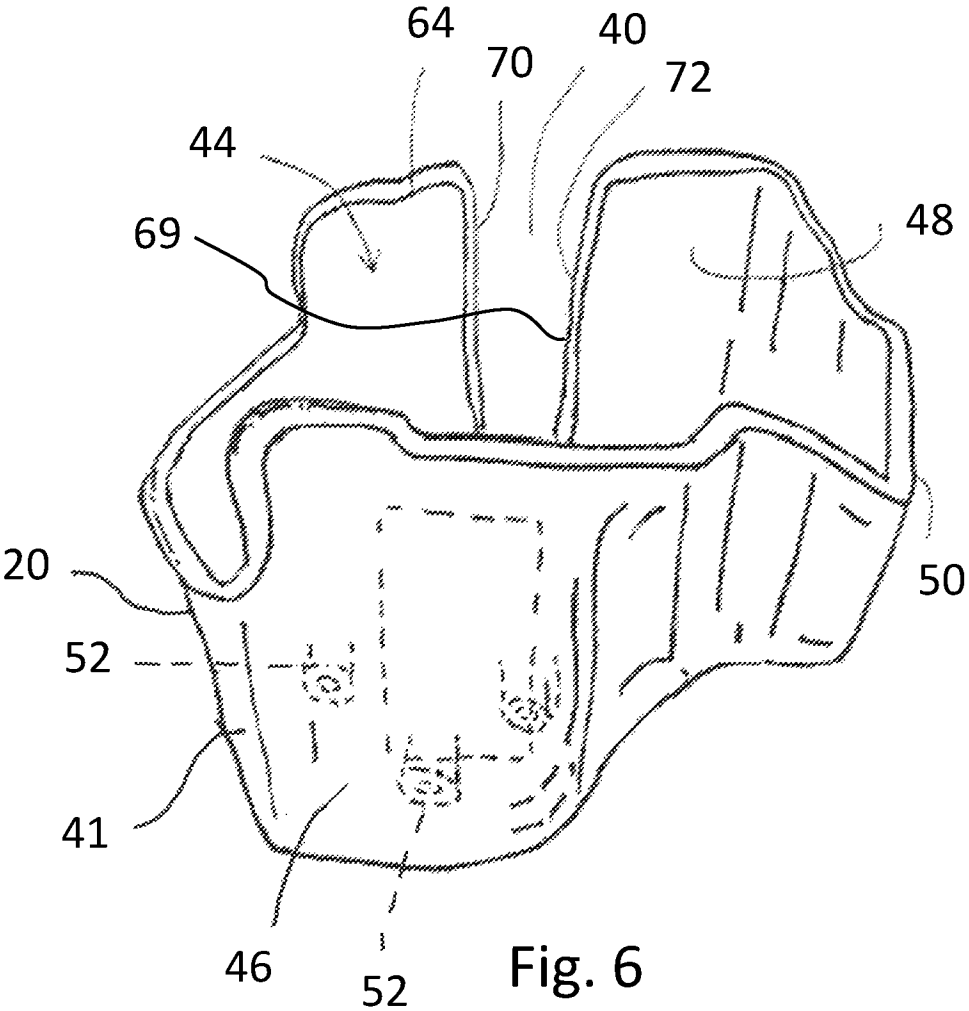
FIG. 6 is a perspective view of the holster of FIG. 5 from a rear view.

Referring to FIGS. 5B and 6 the holster body 41 is illustrated and has a rigid polymer housing 42 defining a handgun receiving cavity 44 therein. Opposing sidewall portions 46, 48 are connected by a forward wall portion 52 and a rearward wall portion 50. Attachment bosses 52 are for connecting the holster to a suitable mounting system. The holster sidewall away from user when worn, the distal sidewall 48, has the master grip forefinger slot 40 therein that extends downward, with respect to a holster being worn by the user standing, or forwardly with respect to the handgun, or when the user is sitting, from the upper margin 64 of the holster. The forefinger slot defined by a slot defining margin 69, including a forward and rearward margins or edge portions 70, 72 and a curved end margin 73 at the user's forefinger tip and being generally sized for and configured for the user's forefinger 32.4. The slot may extend one inch or more into the distal side wall from the upper margin and can accommodate, in embodiments, at least the distal phalange of the user's forefinger. In embodiments the slot may be up to 3.75 inches measured from the upper margin forward of the slot to the lowest end of the slot. In embodiments the slot may be up to 3.25 inches measured from the upper margin forward of the slot to the lowest end of the slot. The forward margin and rearward margin may be generally straight and may be parallel or within 30 degrees of parallel in embodiments. In embodiments, the forward margin and rearward margin may be substantially straight and be angled with respect to each other of 25 degrees or less.

Figure 7:
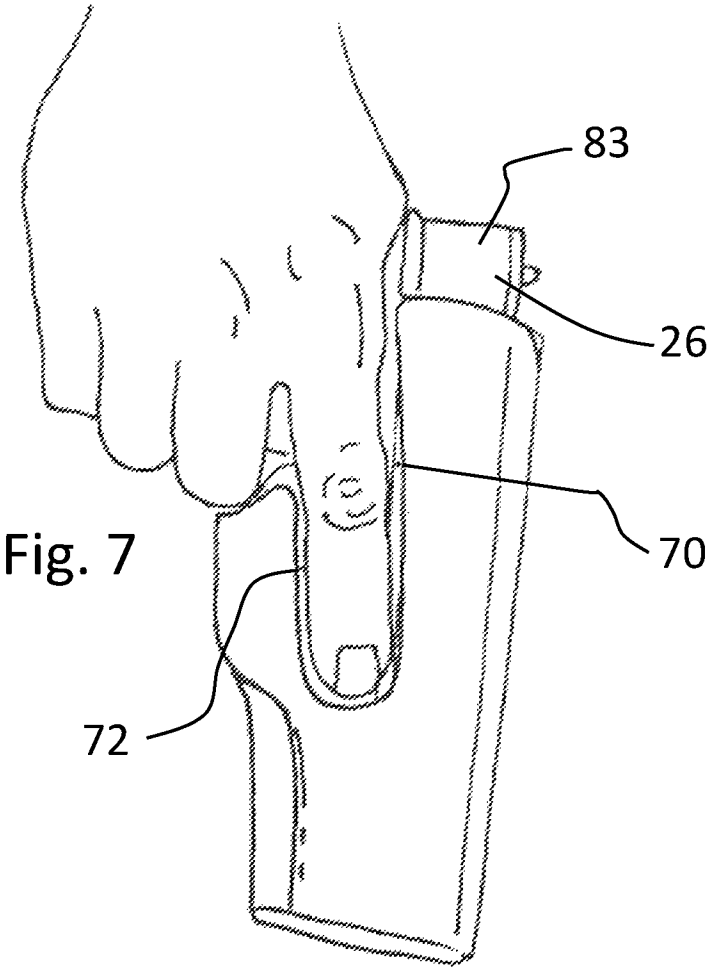
FIG. 7 is a side view of another holster embodiment, the holster having a handgun therein gripped by a user, the user gripping the handgun with the master grip.

Referring to FIG. 7, another holster 75 with a master grip forefinger slot 40 is illustrated and has a forward margin 70 significantly longer than the rearward margin 72. The holster has a body 80 that extends proximate the rearward end 83 of the slide 26.

Figure 12:
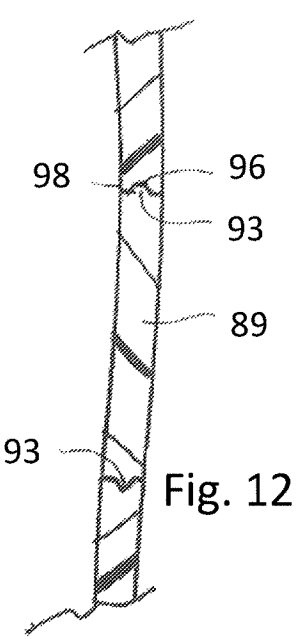
FIG. 12 is a cross-sectional view taken at line 12-12 of FIG. 10.
Figure 11:
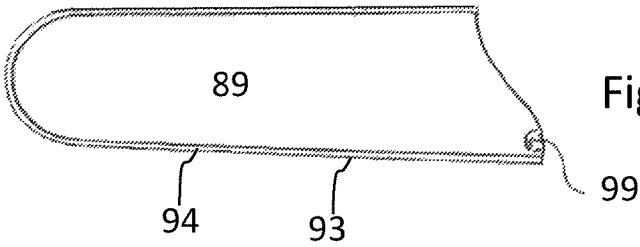
FIG. 11 is a side view of the insert of FIG. 10.

The rigid holster with the forefinger slot is particularly amenable to holsters with thumb actuation buttons. Such buttons may require depressing toward the handgun or pushing a pad forwardly. Referring to FIGS. 8-14, a holster 87 with a master grip forefinger slot 40, having an insert 89 inserted therein, and having a thumb actuated release mechanism 90 are illustrated. As best shown in FIGS. 10-12, the insert 89 may have a central protrusion or rib 93 extending along the insert margin 94 that interfaces with a groove 96 extending along the slot defining margin 98 of the distal wall portion of the holster. A nub 99 or gripping feature may aid in removal of the insert from the master grip forefinger slot 40.

Figure 9:
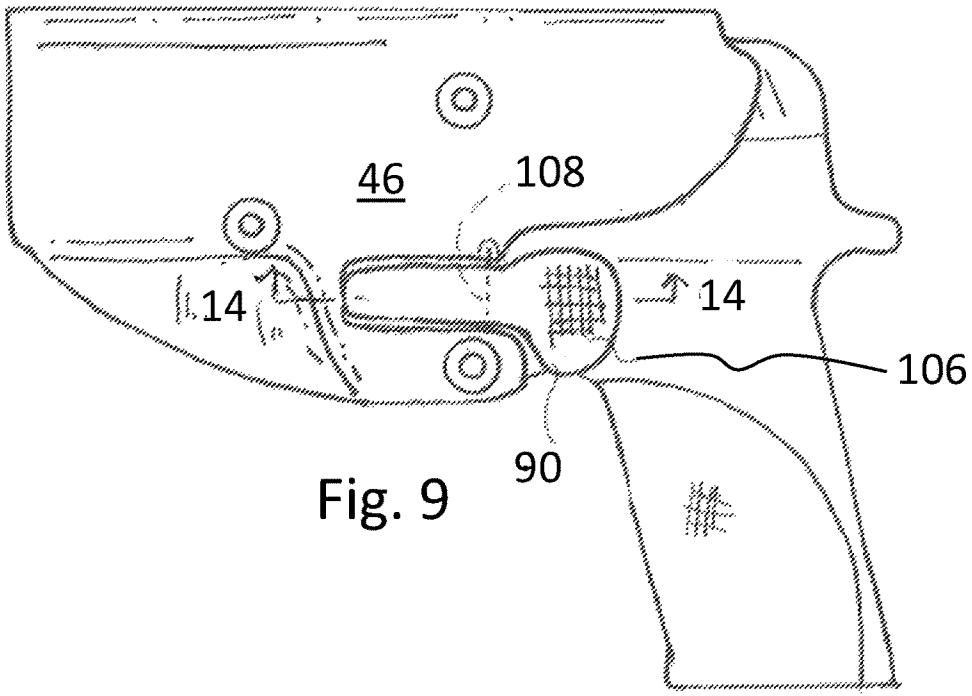
FIG. 9 is the semiautomatic handgun with a slide holstered in a holster of FIG. 8, with a thumb actuated release.
Figure 8:
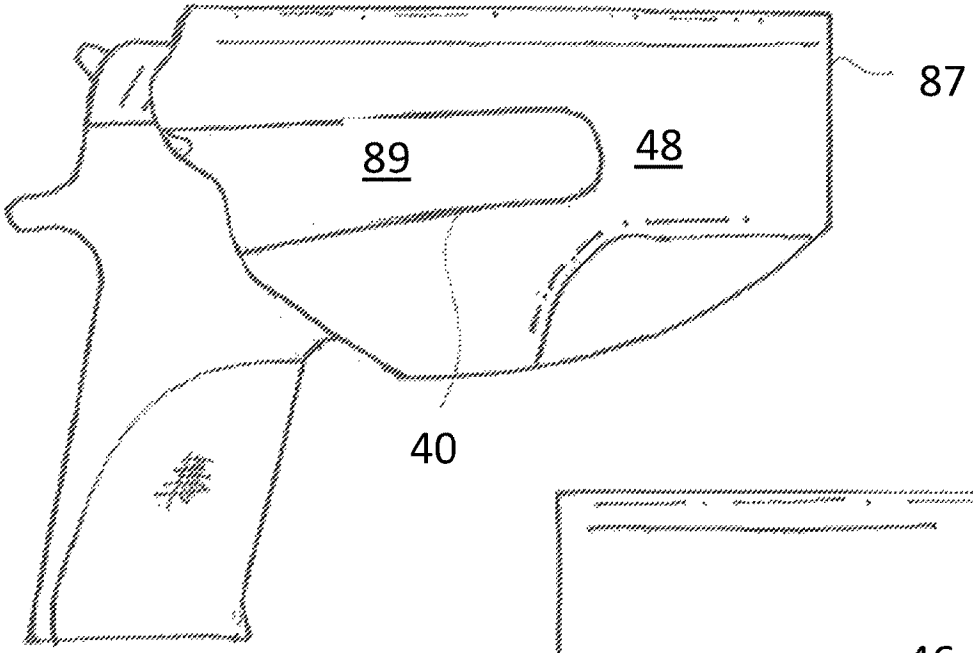
FIG. 8 illustrates a semiautomatic handgun with a slide holstered in a holster with a forefinger slot, the slot having an insert closing the slot.
Figure 13:
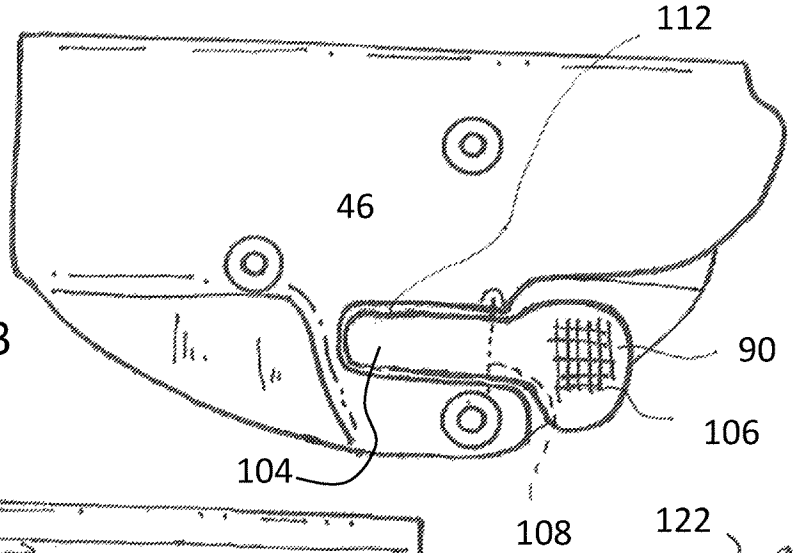
FIG. 13 is a side elevation view of the holster of FIG. 13.
Figure 10:
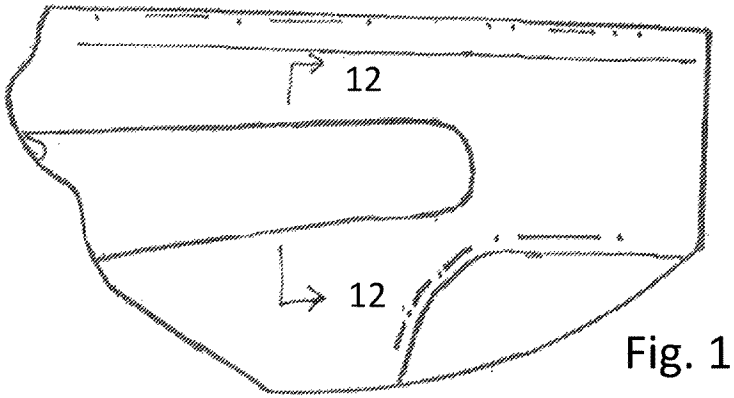
FIG. 10 is a side elevation view of a holster with a forefinger master grip slot with a insert therein.
Figure 14:
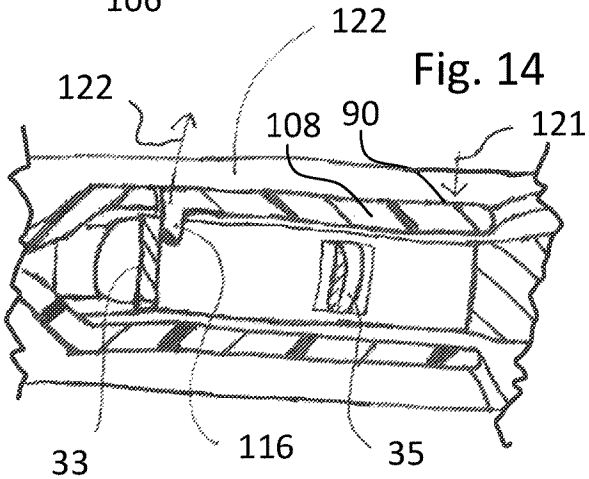
FIG. 14 is a cross-sectional view taken at line 14-14 of FIG. 9.

Referring to FIGS. 9, 13, and 14, the thumb actuated release mechanism 90 is illustrated. A lever 104 with a thumbpad 106, pivots about a pin 108 in a conforming recess 112 in the proximal sidewall portion 46. The lever has a stop portion 116 that in a normal position obstructs the removal of the handgun by blocking the trigger guard 33. Depression of the thumbpad 90 as indicated by arrow 121 pivots the lever about pin 108 and moves the stop portion 116 outwardly, as indicated by arrow 122, to a non-obstructing position allowing removal of the handgun from the holster. Other known release mechanisms may also be utilized. See for example, U.S. Patents and Publications: U.S. Pat. Nos. 9,393,165, 9,134,093, 8,602,275, 9,759,515, and 2019/0293386. All incorporated by reference herein for all purposes.

Figure 15:
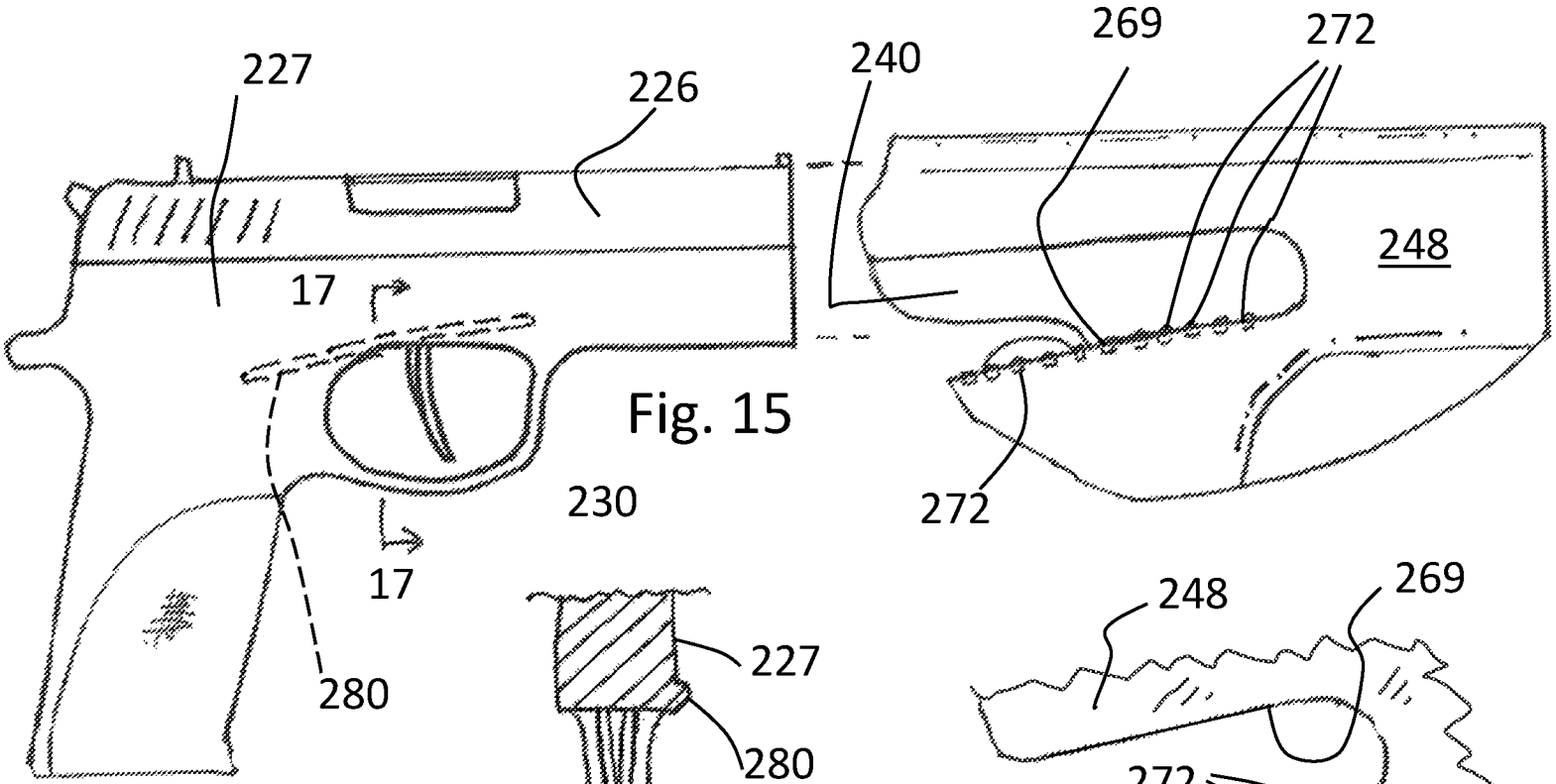
FIG. 15 is a side elevation view of a combination semiautomatic handgun with a slide and a holster having a master grip forefinger slot with a non-smooth lower margin at the slot.
Figure 16:
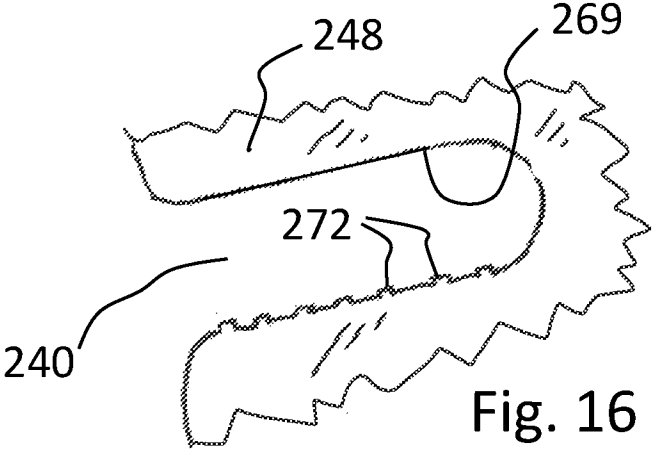
FIG. 16 is a side elevational view of another embodiment of the slot with the lower margin having a serrated edge.
Figure 17:
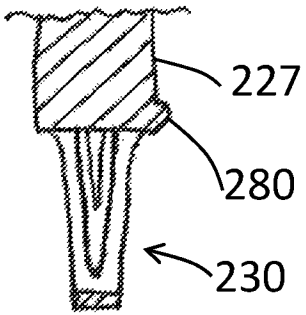
FIG. 17 is a cross-sectional view taken at line 17-17 of FIG. 15 illustrating a rib defining the lower margin of the forefinger placement on the handgun.

Referring to FIGS. 15-17, a handgun 222 and holster 220 with a master grip forefinger slot 240 with additional features are illustrated. In embodiments, the margin 269 defining the forefinger slot in the distal sidewall portion 248 may have projections 272 or non-smooth features to providing a reminder or cue to the user to maintain, that is freeze, his forefinger on the body 227 of the handgun between the slide 226 and the trigger region 230 as the handgun is being withdrawn. The non-smooth features may provide a scrapping or tactile sensation that can aid in freezing the master grip position of the forefinger, discouraging premature migration of the forefinger to the trigger region. The handgun may also have a rib 280 projecting from the handgun body 227 that can further operate as a cue or reminder to maintain the forefinger in the master grip position between the handgun slide and trigger region on the handgun body. The rib providing a physical obstruction to moving the forefinger to the trigger region. The rib 280 may be aligned with the master grip forefinger slot 240 and may be utilized with or without the non-smooth features on the slot defining margin 269.

The invention claimed is:

1. A polymer holster for receiving a handgun with a slide, a body, and a trigger region, the holster having a master grip forefinger slot positioned to place the user's forefinger on the handgun body between the slide and the trigger region when the handgun is holstered and a user is grasping the handgun, the slot having the shape of a profile of a user's forefinger and positioned such that the body of the handgun that receives the forefinger in the master grip is exposed through the slot when viewed from a side of the holster when a handgun is received in the holster, the holster covering the trigger such that trigger is visually obstructed when viewed from the side of the holster.

2. The polymer holster of claim 1, further comprising a thumb actuated handgun release mechanism.

3. The polymer holster of claim 1, wherein a margin defining the master grip forefinger slot has structure projection therefrom providing a non-smooth surface at the margin.

4. The polymer holster of claim 1 in combination with the handgun, the handgun having a rib projecting from the body of the sidewall, the rib aligned with the master grip forefinger slot when the handgun is holstered.

5. The polymer holster of claim 1, further comprising attachment means for securing the holster to a user.

6. The polymer holster of claim 1 in combination with the handgun.

7. A polymer holster for receiving a handgun with a slide, a body, and a trigger region, the holster having a forefinger slot positioned to place the user's forefinger on the handgun body between the slide and the trigger region when the handgun is holstered and a user is grasping the handgun, the slot having the shape of a profile of a user's forefinger and positioned such that the body of the handgun that receives the forefinger is exposed through the slot when viewed from a side of the holster when a handgun is received in the holster, the holster covering the trigger such that trigger is visually obstructed when viewed from the side of the holster.

8. The polymer holster of claim 7, in combination with the handgun.

* * * * *